United States Patent [19]

Smedberg et al.

[11] Patent Number: 4,732,033

[45] Date of Patent: Mar. 22, 1988

[54] PNEUMATIC DIE CUSHION

[75] Inventors: Kenneth L. Smedberg, 5 Oak Hill Dr., Crete, Ill. 60417; Robert J. Kotynski, South Holland; George J. Bozich, Chicago, both of Ill.

[73] Assignee: Kenneth L. Smedberg, Crete, Ill.

[21] Appl. No.: 912,332

[22] Filed: Sep. 26, 1986

[51] Int. Cl.[4] ..... B21D 24/02

[52] U.S. Cl. ..... 72/453.13; 72/344; 267/119; 267/122; 267/130

[58] Field of Search ..... 72/453.13, 347, 348, 72/349, 344, 456, 455; 267/118, 119, 122, 130; 100/214

[56] References Cited

U.S. PATENT DOCUMENTS

| | | | |
|---|---|---|---|
| 2,878,012 | 3/1959 | Crites | 267/122 |
| 3,295,846 | 1/1967 | Robertson | 267/122 |
| 3,488,045 | 1/1970 | Balunas, Jr. et al. | 267/119 |
| 3,511,491 | 5/1970 | Kraft | 267/119 |
| 3,667,707 | 6/1972 | Mui | 267/122 |
| 3,989,232 | 11/1976 | Steinbach et al. | 267/122 |
| 4,597,475 | 7/1986 | Lassig et al. | 267/122 |

FOREIGN PATENT DOCUMENTS

| | | | |
|---|---|---|---|
| 841379 | 4/1952 | Fed. Rep. of Germany | 267/122 |
| 153134 | 11/1981 | Japan | 267/122 |

*Primary Examiner*—Robert L. Spruill

*Assistant Examiner*—David B. Jones

*Attorney, Agent, or Firm*—Anthony S. Zummer

[57] ABSTRACT

A pneumatic die cushion for use in a power press is the subject matter of this invention. The die cushion includes a pair of spaced substantially parallel plates with resilient bellows for resiliently spacing apart the plates. A plurality of limiter pins are releasably secured to one of said spaced plates. Each of said limiter pins has an end threadedly mounted in one of said plates. Each of said limiter pins is movable relative to the other of said plates. A stop mechanism is mounted on the other end of each limiter pin for limiting movement of the first mentioned plate away from the other plate. A limit sleeve is mounted on each of the limiter pins to control the minimum spacing between the plates. A quick change adaptor plate is fixed to one end of the bellows. The quick change adaptor plate has a pair of opposed ears. A mechanism is provided to releasably secure the ears of the quick change adaptor plate to said one of said plates to secure said one end of the bellows to said one of said plates. A second quick change adaptor plate is fixed to the other end of the bellows. The second quick change adaptor plate also has a pair of second opposed ears. A second mechanism releasably secures the second ears of the second quick change adaptor plate to the other of the spaced plates to secure the other end of the bellows to the other of the spaced plates.

18 Claims, 9 Drawing Figures

PNEUMATIC DIE CUSHION

BACKGROUND OF THE INVENTION

Power presses are built in a wide variety of styles and sizes and those presses have a variety of applications, such as, forging, stamping, drawing, or other functions. A common construction of a power press is a double action press which combines the functions of blank holding with drawing. In many stamp and drawing operations, it has been found to be desirable to provide a die cushion which holds a blank to allow the metal of the blank to flow during working. A die cushion is often used to eject a worked blank. Die cushions come in various forms. A well known form is a rubber tankless type. Another well known form is a piston type which is an air cylinder assembly.

Die cushions utilizing an air cylinder assembly are generally a typical air cylinder construction having a cylinder and a piston movably relative to the cylinder. The construction of the air cylinder, as is conventional, utilizes various types of seals and packings to retain the air under pressure. The constant movement of the piston in the cylinder often results in wear in the seals and packing so that there is a constant loss of air from the cylinder, thereby causing the air to be wasted. The loss of air causes a needless operating cost in the operation of a press having an air cylinder die cushion. Importantly, the loss of air causes a variance in the holding force of the air cylinder resulting in a variance in the product produced by the press. In some instances, the variance causes some of the product to be unusable and thus be scrap.

The constant impact loading on a power press and die cushion causes wear to occur in the press and die cushion. It follows that it becomes necessary to maintain and repair the press as well as the die cushion. A desirable construction of a die cushion is one wherein the die cushion may be easily disassembled for maintenance or repair or the die cushion may be easily removed as a unit. Furthermore, it is desirable to provide a die cushion which has substantially no wear or air loss in operation.

SUMMARY OF THE INVENTION

The present invention relates to a pneumatic die cushion for use in a power press. The die cushion includes a pair of substantially parallel spaced flat plates resiliently spaced from each other by a resilient pneumatic bellows mounted between the plates. A plurality of limiter pins is releasably secured to one of said spaced plates. Each of the limiter pins has a threaded end threadedly mounted in said plate. The other plate is movable relative to the plurality of limiter pins. The other pin of each of the limiter pins is threaded and has a nut mounted thereon to limit the movement apart of the spaced plates. A limit sleeve is mounted on each of the limiter pins controlling the movement of the plates toward each other to define a minimum spacing between the plates and thereby accommodate the resilient pneumatic bellows between the plate. A quick change adapter plate is fixed to one end of the bellows. The quick change adaptor plate has a pair of opposed outwardly extending ears. Means releasably secure the ears of the adaptor plate to one of said flat plates to secure that end of the bellows to that flat plate. A second quick change adaptor plate is fixed to the other end of the bellows. The second quick change adaptor plate has a pair of second opposed ears. Second means releasably secure the second ears of the second adaptor plate to the other of the first plates to secure the other end of the bellows to the other of the flat plates.

DESCRIPTION OF THE PREFERRED EMBODIMENT

Figure 1:
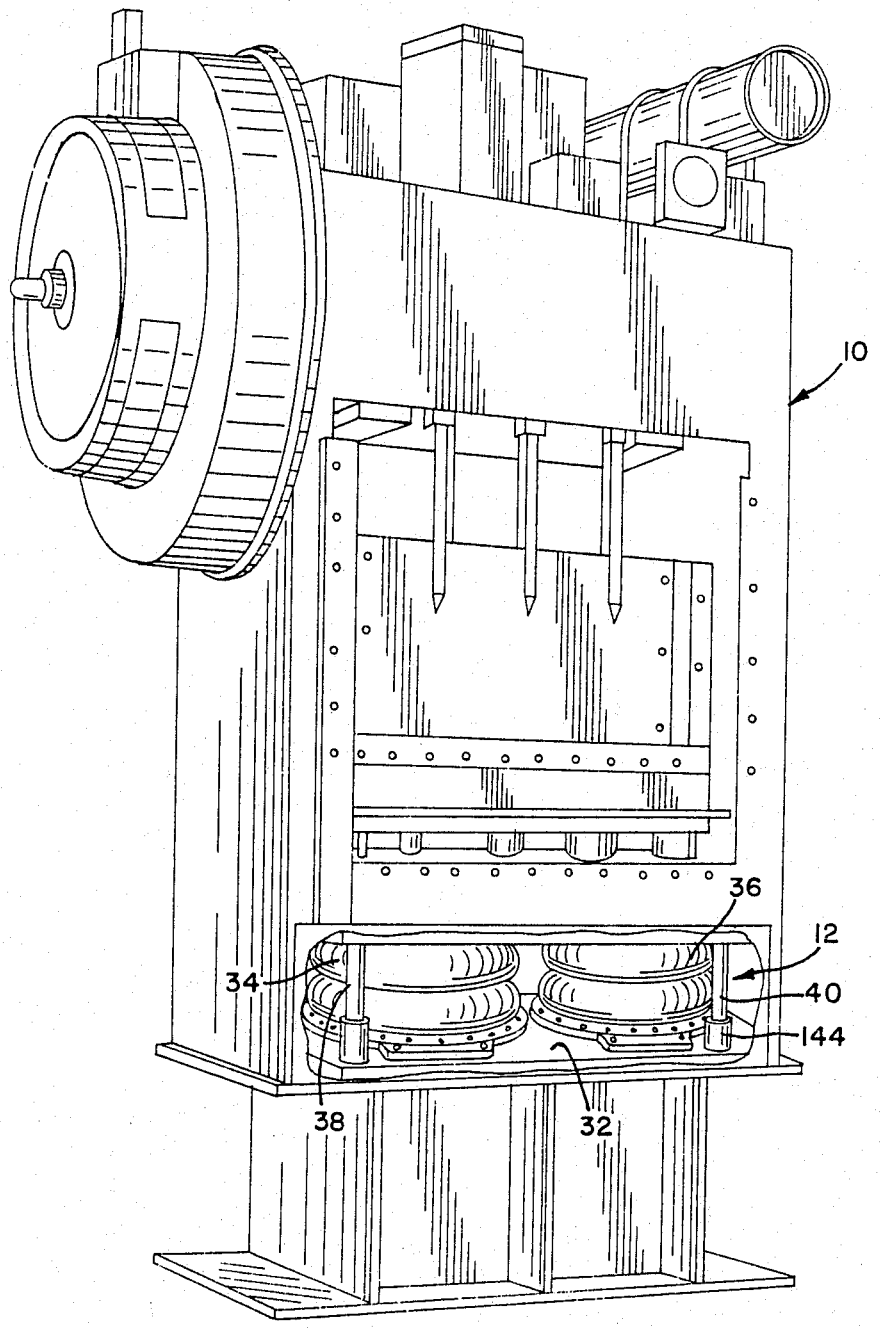
FIG. 1 is a perspective view of a conventional power press with a portion of the press broken away in order to show a cushion die embodying the herein disclosed invention mounted within the press.
Figure 2:
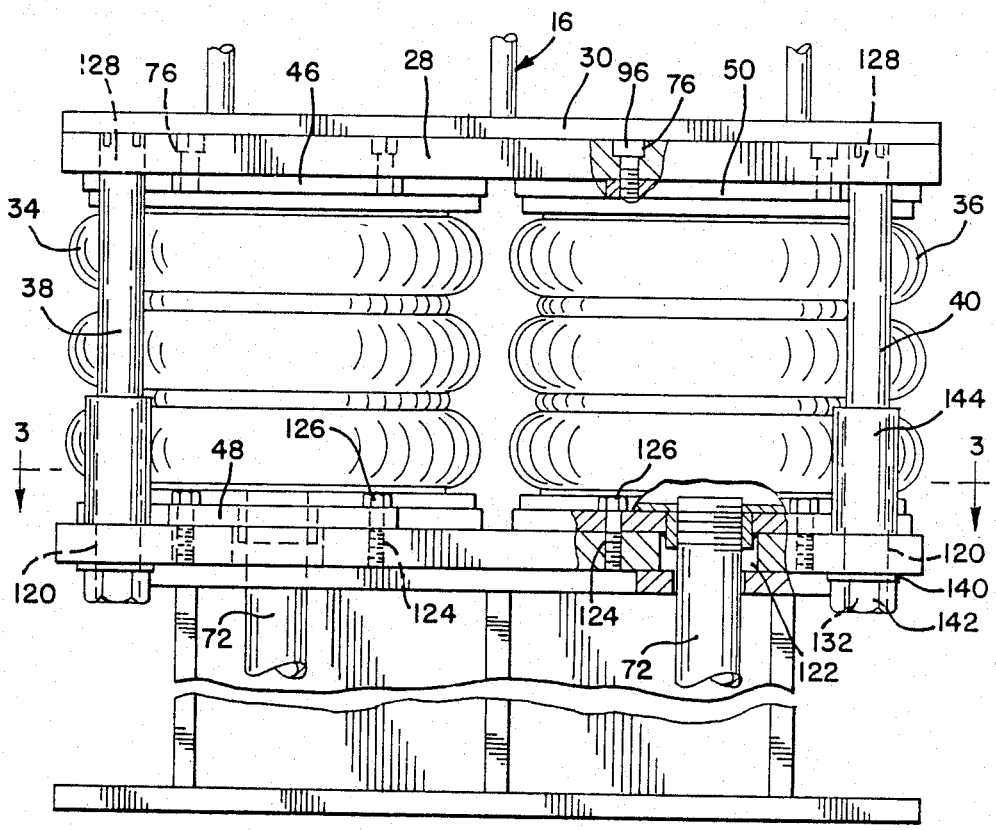
FIG. 2 is an enlarged side elevational view of the cushion die shown in FIG. 1.
Figure 3:
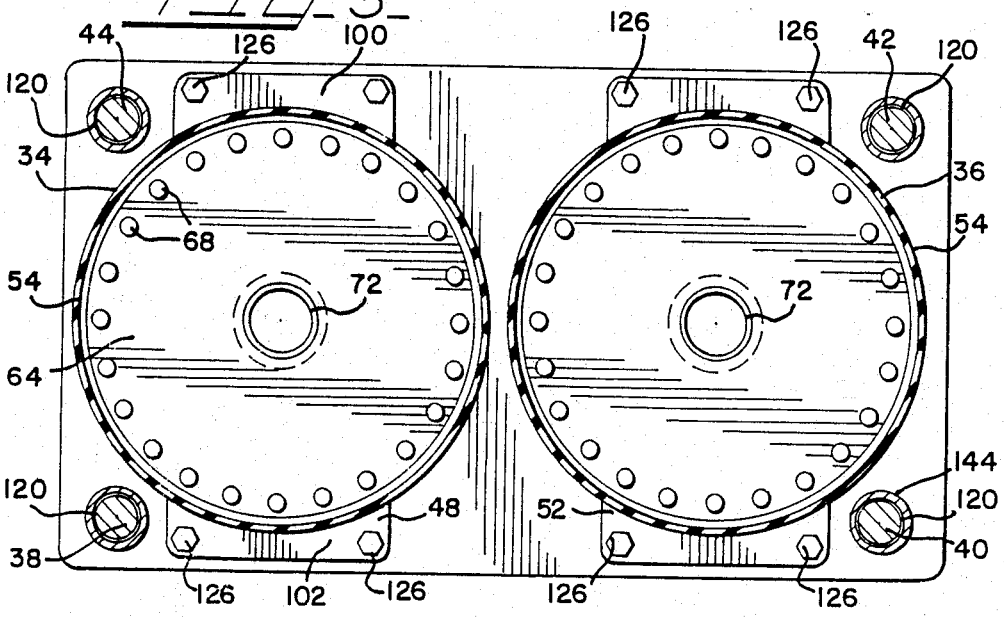
FIG. 3 is a cross sectional view taken on line 3—3 of FIG. 2.
Figure 4:
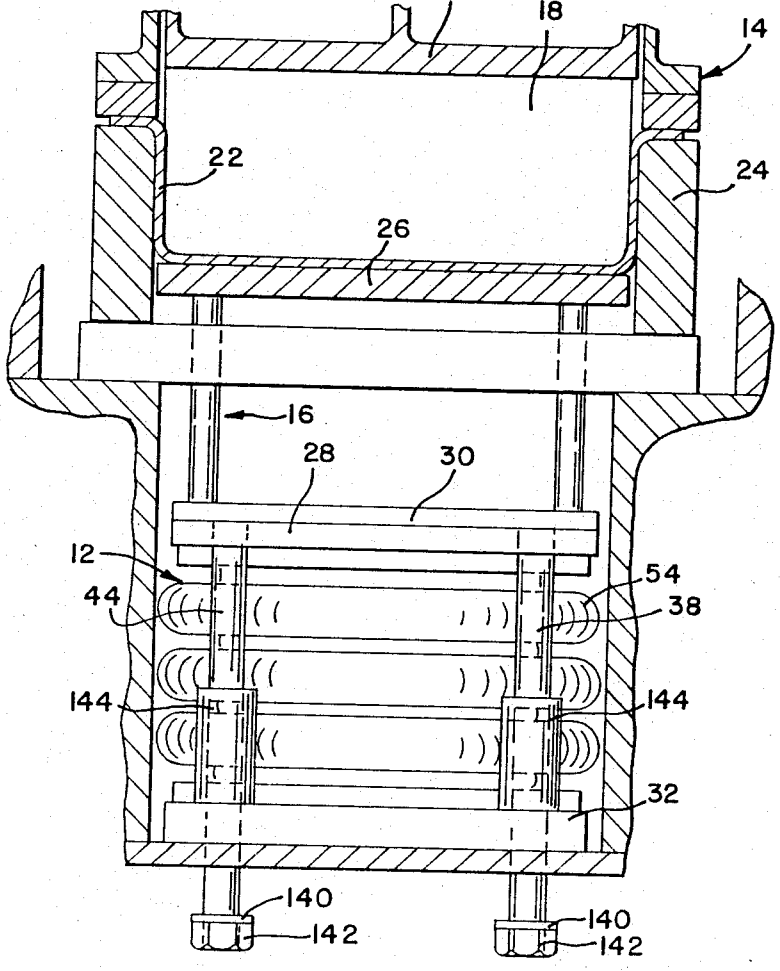
FIG. 4 is an enlarged cross sectional view of a portion of the press shown in FIG. 1 showing a portion of a die with a blank within the die.

Referring now to the drawings, a conventional power press 10 is shown in FIG. 1. The power press 10 has a pneumatic die cushion 12 (embodying the instant invention) mounted in a die well of the power press. As may be seen in FIG. 4, the die cushion 12 is connected to a conventional drawing die 14 through a support 16.

Die 14 is a conventional die which includes a male portion 18 connected to a ram 20 of the press. A metal blank 22 is mounted in a female portion 24 of the die. The female portion includes a movable base 26 which is connected to die cushion 12 by conventional support 16.

Die cushion 12 includes an upper plate 28 with a conventional striker plate 30 bolted to the upper plate (the bolts are not shown in the drawings). A lower plate 32 is spaced from the upper plate 28. A pair of resilient conventional bellows 34 and 36 resiliently space the plates from each other. Four limiter pins 38, 40, 42, and 44 hold the plates substantially parallel to each other. Bellows 34 has its upper end secured to an upper quick change adaptor plate 46 which in turn is releasably secured to upper plate 28. Bellows 34 has its lower end secured to a lower quick change adaptor plate 48 which is releasably secured to the lower plate 32. Bellows 36 has its upper end secured to an upper quick change adaptor plate 50 which is identical in construction to adaptor plate 46. Adaptor plate 50 is releasably secured to upper plate 28. Bellows 36 has its lower end secured to lower quick change adaptor plate 52 which is identical to adaptor plate 48. Lower adaptor plate 52 is releasably secured to lower plate 32.

Bellows 34 and 36 are identical in construction to each other. Each of the bellows includes a boot 54 with a pair of rings 56 mounted thereon. The boot has a top cap 58 secured to the upper end of the boot with a seal 60 to provide a sealing engagement between the top cap and the upper end of the boot. The top cap has twenty-four fastener receptacles 62 arranged in a circle. Each of the receptacles 62 has an internal thread. A bottom cap 64 is mounted on the bottom of each boot and is sealingly connected to the boot through an annular seal 66. The bottom cap has twenty-four fastener receptacles 68 arranged in a circle. Each of the fastener receptacles 68 has an internal thread. Bottom cap 64 includes a pipe aperture 70 for receiving an air inlet pipe 72.

Upper plate 28 is a generally rectangular plate having a uniform thickness. Four threaded guide pin apertures 74 are formed in the plate. Each of the guide pin apertures is adjacent to a corner of the plate. The upper plate also contains eight screw receptacles 76.

Figure 5:
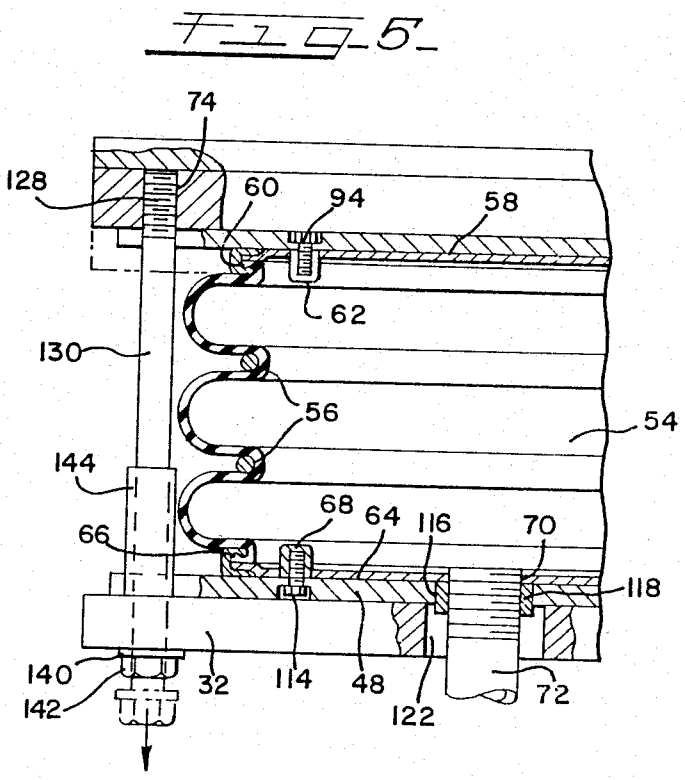
FIG. 5 is a partial cross sectional view of a portion of the die cushion showing a portion of a bellows.
Figure 6:
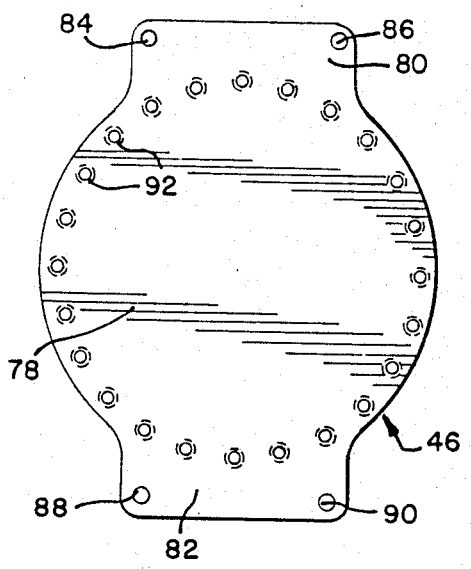
FIG. 6 is a plan view of an upper adaptor plate of the cushion die shown in FIGS. 1 and 2.

The upper quick change adaptor plate 46 is identical to the other upper quick change adaptor plate 50. Adaptor plate 46 is shown in FIG. 6. Adaptor plate 46 is a substantially flat steel plate having a base portion 78 with an ear 80 formed on one side and an ear 82 formed on the side opposite ear 80 so that the ears extend outwardly from each other from the base portion. A pair of internally threaded holes 84 and 86 is formed in ear 80. A second pair of internally threaded holes 88 and 90 is formed in ear 82. The holes 84, 86, 88 and 90 are positioned to align the four holes 76 in the upper plate 28. Adaptor plate 46 contains twenty-four holes 92 which are arranged in a circle which holes 92 are each aligned with a respective internally threaded receptacle 62. Each of the holes 92 is drilled and countersunk to receive a machine screw 94 as shown in FIG. 5. Upper adaptor plate 46 is secured to top cap 58 on the upper end of the bellows by twenty-four machine screws 94 positioned in holes 92 and threadedly mounted in the internally threaded receptacles 62 so that adaptor plate 46 is secured to the cap. Four machine screws 96 are positioned in the holes 76 in the upper plate and threadedly engage the internally threaded holes 84, 86, 88 and 90 to secure the adaptor plate to upper plate 28.

Figure 7:
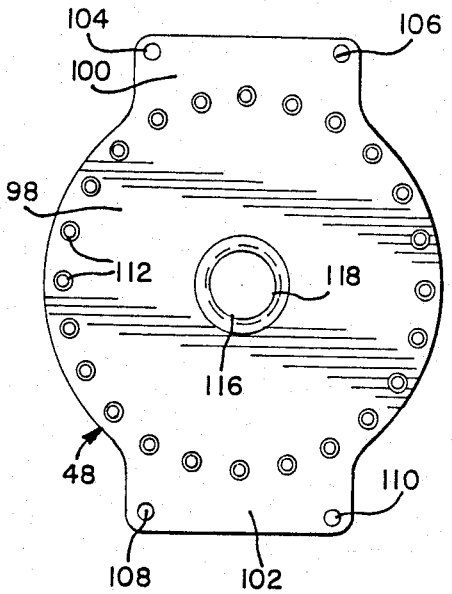
FIG. 7 is a plan view of a lower adaptor plate of the die cushion of FIGS. 1 and 2.
Figure 8:
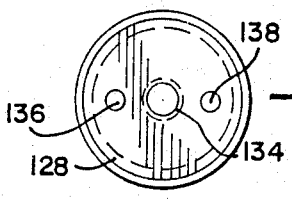
FIG. 8 is an end elevational view of a limiter pin.
Figure 9:
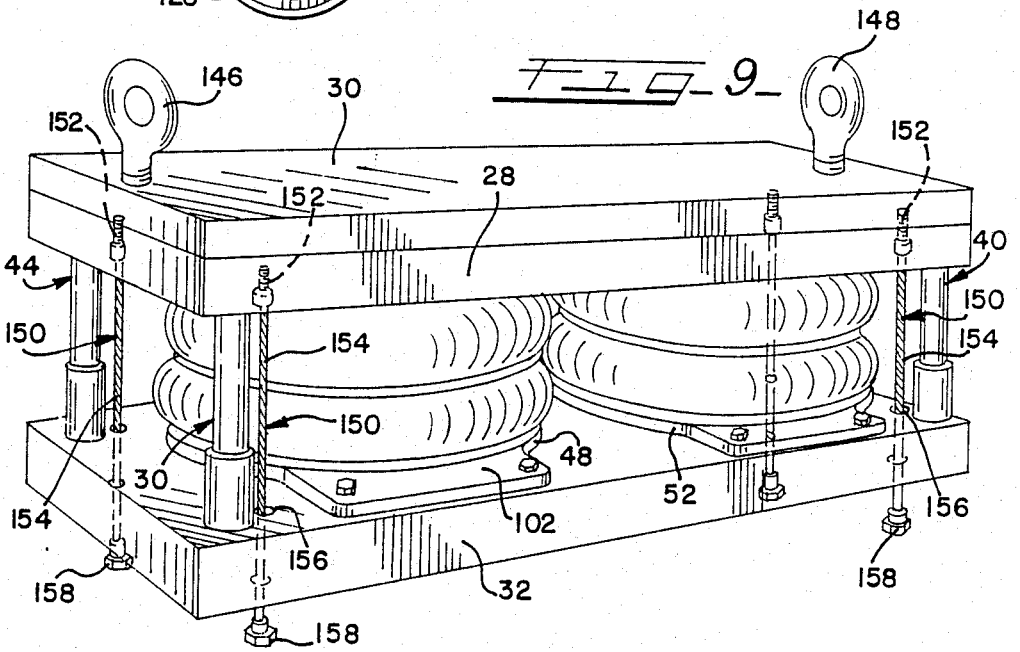
FIG. 9 is a perspective view of the cushion die of FIGS. 1 and 2 with restraining cables connected to a pair of opposed plates.

Lower adaptor plate 48 is shown in FIG. 7. Lower adaptor plate 48 is identical to lower adaptor plate 52. Lower adaptor plate 48 includes a base portion 98 with an ear 100 formed integral with one side of the base portion. An ear 102 is formed integral with the base portion opposite to ear 100 so that the ears extend outwardly from each other. Ear 100 has a pair of holes 104 and 106 formed therein. Ear 102 has a pair of holes 108 and 110 formed therein. The base portion has twenty-four holes 112 arranged in a circle which holes 112 may be aligned with respective threaded receptacles 68 of bottom cap 64. Holes 112 are countersunk to receive screws 114 to secure bottom adaptor plate 48 to bottom cap 64. The bottom adaptor plate contains an aperture 116 with a collar 118 aligned with the aperture. The collar is internally threaded to receive pipe 72 and is aligned with opening 70.

Bottom plate 32 is similar to the upper plate 28. Bottom plate 32 is rectangular in shape and has four holes 120 formed in its four corners. Holes 120 are aligned with threaded holes 74 of upper plate 28. Bottom plate 32 contains a pair of pipe apertures 122 to receive pins 72 connected to bellows 34 and 36. The lower plate includes eight threaded screw apertures 124, four of which are alignable with the apertures 104, 106, 108 and 110 of bottom adaptor plate 48 and the remainder with like apertures of bottom adaptor plate 52. Screws 126 are mounted in holes 104, 106, 108 and 110, and are threadedly mounted in apertures 124 to secure releasably bottom adaptor plate 48 to lower plate 32.

Each of the limiter pins 38, 40, 42, and 44 is identical in construction to each of the other limiter pins. Each limiter pin has at one end a threaded portion 128 which is threadedly mounted in each of the threaded apertures 74 of upper plate 28. Each limiter pin has a cylindrical body 130 with a threaded portion 132 at the other end for receiving a stop means. The upper end of each limiter pins has a wrench receptacle portion on the end of the limiter pins having the threaded portion 128. The receptacle portion includes an internally threaded opening 134 in the center with a pair of holes 136 and 138 on a straight line with center hole 134. These openings provide a means for connecting a wrench to the end of the limiter pins when the limiter pin is connected to the upper plate.

The stop at the other end of the limiter pin includes a conventional washer 140 mounted on threaded end 132 and a conventional nut 142 mounted on threaded portion 132 holding the washer in place.

A limit sleeve 144 is slidably mounted on the body of each limiter pin. Each limit sleeve is of a sufficient heighth to prevent bellows 34 and 36 from being damaged when plates 28 and 32 are moved toward each other. Limit sleeves 144 define a minimum spacing between the plates so that when the bellows are collapsed, there is no danger of any damage to the bellows.

The operation of press 10 is conventional in that upon activation, ram 20 moves down toward blank 22, so that male portion 18 of the die engages the blank, the blank engages bottom 26 and bottom 26 is connected to the striker plate by conventional connector 16. The striker plate is connected to the upper plate 28 by conventional bolts which are not shown. Bottom 26 is support by the two bellows 34 and 36. The bellows offer a selected resistance to the downward movement of the bottom 26 against the force of the ram to hold the blank between the bottom 26 and the male die as is conventional. As upper plate 28 moves downward, the limiter pins slide in limit sleeve 144 and in openings 120 in the bottom plate. Air contained in the bellows is restricted to the bellows and none of the air escapes, but rather is compressed and pushes the boots outward. The bellows are strengthened by rings 56. In the event of loss of air pressure, the downward movement of plate 28 is limited by limit sleeves 144 so that the boots are not crushed.

It may be appreciated that the resistance offered by the bellows is controlled mainly by the pressure of the air contained in the bellows. The air pressure may be regulated by the introduction or removal of air from the bellows through pipes 72, as is conventional and well known. Pipes 72 are connected to a conventional source of compressed air through a conventional air regulator, which regulator and source is not shown herein.

As is conventional with many power pressess, the well of the press does not have any convenient means for getting into the well other than through the top opening once the press is set up. The construction of the present die cushion is such that repairs and maintenance may be easily accomplished. In order to repair the die cushion or to replace the boot, the present construction allows a simple and easy method of making the replacement or repair.

In order to repair the present die cushion, die 14 is removed, as is conventional, along with connector 16, thereby exposing striker plate 30. The bolts securing the striker plate to the upper plate 28 are loosened to remove the striker plate from the upper plate. A wrench is inserted in the end of each of the limiter pins to turn the limiter pins and thereby loosen each of the limiter pins from the upper plate allowing the limiter pins to drop down. Screws 96 are then removed from engagement with the upper adaptor plates. It may be appreciated that there are only four screws for each of the quick change adaptor plates. Once the screws 96 are removed, the upper plate may be lifted off the upper quick change adaptor plates. Also, it may be appreciated that screws 126 are thus exposed so that those screws may be easily loosened, requiring only four screws to be loosened, thus, releasing the lower quick change adaptor plate from bottom plate 32. Each of the bellows with the quick change adaptor plates may then be lifted. In each instance, pipe 72 is lifted and may be disconnected from the adaptor plate. Thus, each bellows with the adaptor plates may be lifted out of the well for servicing. In the event that it is necessary to replace the boots, a new bellows with the quick change adaptor plates is positioned in place, and pipe 72 is attached to the new bellows. Four screws 126 are only required to secure the bottom adaptor plate to the lower plate for each bellows. Screws 96 are then secured to the upper adaptor plate through upper plate 28 to secure the upper adaptor plate to the upper plate. The limiter pins are then threadedly positioned in each of the respective threaded openings 74 and are threadedly connected thereto. The striker plate is then reconnected to the upper plate. Compressed air is introduced into the bellows. The bellows are then extended and the stops limit the upward movement of the upper plate.

It may be appreciated that in certain instances, it is desirable to provide means for removing the entire unit from the well. In those instances, a pair of eyebolts 146 and 148 are mounted in striker plate 30. Thus, the die cushion is lifted by eyebolts 146 and 148. It may be appreciated that the utilization of the eyebolts allows the ram of the press to lift the die cushion from the well.

Four identical restraining cables 150 are secured to upper plate 28 and extend through lower plate 32 to provide a safety restraint between plates 28 and 32. Each of the restraining cables includes a threaded mounting head 152 threadedly mounted in the underside of upper plate 28. A high-strength steel cable 154 has one end fixed to mounting head 152. Steel cable 154 is freely movably mounted in a cable opening 156 in lower plate 32. Steel cable 154 has a cable stop 158 fixed to its other end. In the event that the limiter pins should break loose so that the bellows would push plates 28 and 32, the restraining cables would prevent the plates 28 and 32 from flying apart.

Although a specific embodiment of the herein disclosed invention has been shown in detail in the accompanying drawings and described above, it is readily apparent that those skilled in the art may make various modifications and changes without departing from the spirit and scope of the present invention. It is to be expressly understood that the instant invention is limited only by the appended claims.

What is claimed is:

1. A pneumatic die cushion for use in a power press comprising, in combination, a pair of substantially parallel spaced plates, a resilient pneumatic bellows mounted between the plates resiliently holding the plates spaced apart, a plurality of limiter pins releasably secured to one of said spaced plates, each of said limiter pins having a threaded end threadedly mounted in one of said plates, each of said limiter pins having turning means on the end having the threaded end adapted for releasably threadedly mounting the limiter pins in the one plate, each of said limiter pins being movable relative to the other of said plates, stop means mounted on the other end of each limiter pin adjacent to the other of said plates limiting movement in one direction the movement of the first mentioned plate relative to the other plate, and a limit sleeve mounted on each of the limiter pins to control the minimum spacing between the plates.

2. A pneumatic die cushion for use in a power press as defined in claim 1, wherein each limiter pin has on the other end a second threaded portion, and said stop means including a nut threadedly mounted on the second threaded portion.

3. A pneumatic die cushion for use in a power press as defined in claim 1, including a restraining cable having one end secured to a first plate of the pair of substantially parallel spaced plates, and said restraining cable having a stop on its opposite end engageable with a second plate of the pair of substantially parallel spaced plates.

4. A pneumatic die cushion for use in a power press as defined in claim 1, wherein each limiter pin having a second threaded portion on the other end of the limiter pin, said stop means including a nut threadedly mounted on the second threaded portion, and including a restraining cable having one end connected to a first plate of the pair of substantially parallel spaced plates, said restraining cable having a stop on its opposite end engageable with the second plate of the pair of substantially parallel spaced plates.

5. A pneumatic die cushion for use in a power press comprising, in combination, a pair of spaced substantially parallel plates, a resilient bellows mounted between the plates resiliently spacing apart the plates, a plurality of limiter pins secured to one of said plates, each of said limiter pins having one end fixed to one of said plates and the other end being movable relative to the other of said plates, a limit sleeve mounted on each of the limiter pins to control the minimum spacing between the plates, an adaptor plate fixed to one end of the bellows, means releasably securing the adaptor plate to one of said plates to secure said one end of the bellows to said one of said plates, a second adaptor plate fixed to the other end of the bellows, and second means releasably securing the second adaptor plate to the other of the plates to secure the other end of the bellows to the other of the plates.

6. A pneumatic die cushion for use in a power press as defined in claim 5, wherein said pair of spaced parallel plates are arranged with a first plate being positioned above a second plate, and each of said limiter pins having one end fixed to the first plate.

7. A pneumatic die cushion for use in a power press as defined in claim 5, wherein each of said limiter pins has a threaded end threadedly mounted in said one of said plates to secure releasably the limiter pin to said one plate.

8. A pneumatic die cushion for use in a power press as defined in claim 5, including a restraining cable having one end connected to a first of the pair of spaced substantially parallel plates, and said cable having a stop on its opposite end engageable with a second of the pair of spaced substantially parallel plates.

9. A pneumatic die cushion for use in a power press as defined in claim 5, wherein each of said limiter pins has a threaded end releasably threadedly mounted in said one of said plates, each of said limiter pins having a turning receptacle on the end of each limiter pin having the threaded end adapted for threadedly mounting the limiter pin in said one plate.

10. A pneumatic die cushion for use in a power press as defined in claim 5, wherein each of said limiter pins has a threaded end releasably threadedly mounted in said one of said plates, each limiter pin having on its other end a second threaded portion, and a nut threadedly mounted on the second threaded portion for limiting movement of the plates in a direction away from each other.

11. A pneumatic die cushion for use in a power press as defined in claim 5, wherein each of said limiter pins has a threaded end threadedly mounted in said one of said plates, and each of said limiter pins has stop means on the other end to limit movement of the plates away from each other.

12. A pneumatic die cushion for use in a power press as defined in claim 5, wherein the spaced plates are arranged with said one plate being positioned above the other, each of said limiter pins having a threaded end threadedly mounted in said one of said plates.

13. A pneumatic die cushion for use in a power press as defined in claim 5, wherein said pair of substantially parallel spaced plates are positioned with said one plate being positioned above the other plate, each of said limiter pins having a threaded end threadedly mounted in said one of said plates, and each of said limiter pins having a threaded end.

14. A pneumatic die cushion for use in a power press as defined in claim 5, wherein each of said limiter pin has a threaded end threadedly mounted in said one of said plates, and a plurality of restraining cables connected to the plates for limiting movement of the plates away from each other.

15. A pneumatic die cushion for use in a power press as defined in claim 5, wherein the pair of substantially parallel spaced plates are positioned with said one plate being above said other plate, each of said limiter pins having a threaded end threadedly mounted in said one of said plates, each of said limiter pins having a turning receptacle on the end of each limiter pin having the threaded end adapted for threadedly mounting the limiter pin in said one plate, each limiter pin having on the other end a second threaded portion, and a nut threadedly mounted on the second threaded portion of each limiter pin for limiting movement of the plates away from each other.

16. A pneumatic die cushion for use in a power press as defined in claim 5, wherein the plates of the pair of substantially parallel spaced plates are positioned with said one plate being above the other plate, each of said limiter pins having a threaded end threadedly mounted in said one of said plates, each of said limiter pins having a turning receptacle on the end having the threaded end adapted for threadedly mounting the limiter pin in said one plate, each limiter pin having a second threaded portion on its other end, a nut threadedly mounted on the second threaded portion for connection with the other plate, and a restraining cable having one end connected to a first plate of the pair of substantially parallel spaced plates, said restraining cable having a cable stop on its opposite end engageable with a second plate of the pair of substantially parallel spaced plates.

17. A pneumatic die cushion for use in a power press comprising, in combination, a pair of substantially parallel spaced plates, a resilient pneumatic bellows mounted between the plates resiliently holding the plates spaced apart, a plurality of limiter pins secured to one of said spaced plates, each of said limiter pins being movable relative to the other of said plates, and a plurality of restraining cables equal in number to the number of limiter pins connected to a first plate of the pair of substantially parallel spaced plates, each of said cables having a stop on its opposite end engageable with the second of the pair of substantially parallel spaced plates.

18. A pneumatic die cushion for use in a power press comprising, in combination, a pair of spaced parallel plates being positioned one above the other, a resilient bellows mounted between the plates resiliently spacing apart the plates, an adaptor plate fixed to one end of the bellows, said adaptor plate having a pair of opposed ears, screw means extending through the upper plate and threadedly engaging the ears of the adaptor plate to secure releasably said end of the bellows to the upper plate, a second adaptor plate fixed to the other end of the bellows, said second adaptor plate having a pair of second ears extending outwardly from the plate, second screw means extending through each of the second ears of the second adaptor plate and being threadedly mounted in the lower spaced parallel plate for releasably securing the second adaptor plate to the lower plate to secure releasably the other end of the bellows to the lower plate, a plurality of limiter pins releasably secured to the upper spaced plate, each of said limiter pins having a threaded end threadedly mounted in said upper plate, each of said limiter pins having a turning receptacle on the end of the limiter pin having the threaded end, each of said limiter pins extending through an aperture in the lower plate, each of said limiter pins having a second threaded portion on the other end of the limiter pin, a nut mounted on each second threaded portion of each of the limiter pins to limit movement of the plates away from each other, and a limit sleeve movably mounted on each of the limiter pins to control movement of the plates toward each other to a minimum distance between the plates.

* * * * *

UNITED STATES PATENT AND TRADEMARK OFFICE

CERTIFICATE OF CORRECTION

PATENT NO. : 4,732,033

DATED : March 22, 1988

INVENTOR(S) : Kenneth L. Smedberg, et al.

It is certified that error appears in the above-identified patent and that said Letters Patent are hereby corrected as shown below:

Column 1, line 54, cancel "pin" and substitute therefor --end--.

Column 2, line 3, cancel "first" and substitute therefor --flat--.

Column 3, line 60, cancel "pins" and substitute therefor --pipes--

Claim 13, column 7, line 27, after "pins" insert --having a turning receptacle on the end of each limiter pin--.

Claim 13, column 7, line 28, cancel "a" and substitute therefor --the--.

Claim 14, column 7, line 30, cancel "pin" and substitute therefor --pins--.

Signed and Sealed this

Nineteenth Day of July, 1988

*Attest:*

DONALD J. QUIGG

*Attesting Officer*

*Commissioner of Patents and Trademarks*